United States Patent [19]

Stotz et al.

[11] 4,110,156

[45] Aug. 29, 1978

[54] COMPACT PRESS AT THE WEB TRANSFER POSITION OF A PAPER MAKING MACHINE

[75] Inventors: Wolf-Gunter Stotz, Ravensburg; Helmut Hund, Vorberg, both of Fed. Rep. of Germany

[73] Assignee: Escher Wyss Limited, Zürich, Switzerland

[21] Appl. No.: 803,537

[22] Filed: Jun. 6, 1977

[30] Foreign Application Priority Data

Jun. 14, 1976 [CH] Switzerland ..... 7492/76

[51] Int. Cl.[2] ..... D21F 3/04; D21F 3/06; D21F 3/08; D21F 3/10

[52] U.S. Cl. ..... 162/305; 162/306; 162/360 R

[58] Field of Search ..... 162/305, 306, 358, 360 R, 162/205; 29/116 AD, 113 AD

[56] References Cited

U.S. PATENT DOCUMENTS

| | | | |
|---|---|---|---|
| 3,265,559 | 8/1966 | Means | 162/358 X |
| 3,285,806 | 11/1966 | Justus et al. | 162/306 |
| 3,802,044 | 4/1974 | Spillmann et al. | 29/113 AD |
| 3,861,996 | 1/1975 | Dorfel | 162/306 |
| 3,885,283 | 5/1975 | Biondetti | 29/116 AD |
| 3,997,391 | 12/1976 | Ortolani | 162/360 R |
| 4,059,482 | 11/1977 | Kankaanpaa | 162/305 X |

FOREIGN PATENT DOCUMENTS

| | | | |
|---|---|---|---|
| 1,155,277 | 6/1969 | United Kingdom | 162/305 |

*Primary Examiner*—Richard V. Fisher
*Attorney, Agent, or Firm*—Werner W. Kleeman

[57] ABSTRACT

A paper-making machine roll press or mill comprising a suction press roll over which there is trained a press felt, and which simultaneously serves for the direct transfer of a web of paper from a wire. A take-off press roll cooperates with the suction press roll to form a press station. The take-off press roll serves for the transfer of the paper web from the suction press roll and for the delivery thereof to a downstream part of the paper-making machine. An additional press station is provided between the suction press roll and the take-off press roll and is formed by a contact-pressure roll over which there is trained a felt. The contact-pressure roll comprises a hydrostatic flexure adjusting or controlled deflection roll having a shell mounted to be rotatable about its lengthwise axis and displaceable in the press direction relative to a fixed or stationary support.

6 Claims, 2 Drawing Figures

-5-

COMPACT PRESS AT THE WEB TRANSFER POSITION OF A PAPER MAKING MACHINE

BACKGROUND OF THE INVENTION

The present invention relates to a new and improved construction of paper-making machine roll press or roller mill, which is of the type comprising a suction press roll over which there is trained a press felt, and which simultaneously serves for the direct transfer of a web of paper from a wire, there also being provided a take-off press roll which cooperates with the suction press roll to form a press station and such take-off press roll serves for the transfer of the paper web from the suction press roll and for the delivery thereof to a downstream part of the paper-making machine.

A roll press or roller mill of this kind is known, for example, from the publication "Kompakt-Pressen-Systeme" No. 7405/19, published by Messrs. Dörries, page 3. This press, which is known to the art as a compact press, is very economical in terms of its spatial requirements, yet owing to its compact construction it has a relatively limited efficiency, so that as a general rule another press has to be operatively connected therewith. The reason for this is that the lack of space for the necessary contact-pressure mechanisms renders it impossible to provide a press station with two felts for the simultaneous de-watering on both sides. If additional press stations were to be provided between the suction press roll and the take-off press roll, then there would be needed an additional suction roll, for instance as taught in U.S. Pat. No. 3,861,996, in order to take the web of paper from the wire. In that case the press automatically would become longer, therefore not only increasing the machine costs but also its size.

SUMMARY OF THE INVENTION

Hence, it is a primary object of the present invention to provide a new and improved construction of roll press which is not associated with the aforementioned drawbacks and limitations of the prior art proposals.

Another significant object of this invention is to provide a roll press of the previously mentioned type which, while maintaining practically unchanged the spatial requirements, enables the press capacity, i.e. the de-watering effect, to be greatly increased in comparison to prior art presses.

Still a further significant object of the present invention aims at the provision of a papermaking machine roll press or roller mill which is extremely reliable in operation, relatively economical to manufacture, possesses relatively small spatial requirements in comparison to the de-watering effect which can be accomplished thereat, particularly in comparison with conventional roll presses, and furthermore, is relatively easy to use, not readily subject to breakdown or malfunction, and requires a minimum of servicing and maintenance.

Now in order to implement these and still further objects of the invention which will become more readily apparent as the description proceeds, the roll press according to the present invention is manifested by the features that there is provided an additional press station between the suction press roll and the take-off press roll. This additional press station comprises a contact-pressure roll over which there is trained a felt, the contact-pressure roll being in the form of a hydrostatic flexure adjusting roll or controlled deflection roll having a shell which is mounted to be rotatable about its lengthwise axis and which is displaceable in the pressing direction relative to a fixed support.

The flexure adjusting roll or controlled deflection roll which is used in this case is known from U.S. Pat. Nos. 3,802,044 and 3,885,283, the disclosures of which are incorporated herein by reference, and not only has the property of delivering a relatively uniform contact-pressure force, but also the advantage of not requiring any external contact-pressure mechanism. Therefore, it can be installed in a conventional roll press at a location where it would be impossible to install a different roll. If, as contemplated by the invention, a press felt is trained over the contact-pressure roll, the additional effect of practically two press stations is obtained in each case with a single felt. In other words: the efficiency of the roll press can be practically doubled in this manner.

Additionally, the take-off press roll can be provided with at least one additional press station which is formed by a press roll over which there is trained a press felt. This second press roll also comprises a controlled deflection roll or flexure adjusting roll having a shell mounted to be rotatable about its lengthwise axis and displaceable in the pressing direction relative to a fixed support.

Due to these measures the efficiency of the roll press can be further increased, again without increasing the spatial requirements of the roll press or paper-making machine. There is thus realized a roll press having three consecutive press stations of optimum construction. The first press station comprises two-sided or double-face de-watering with suction, the second press station one-sided or one-face de-watering with suction, and the third press station one-sided or one-face de-watering with water evaporation into the felt or grooves formed on the roll shell, which grooves incidentally may be provided on both controlled deflection rolls. The press contains no open runs and there is no risk of the web dropping, as would be the case at places where the web of paper adheres to the bottom of a freely trained felt web.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2:
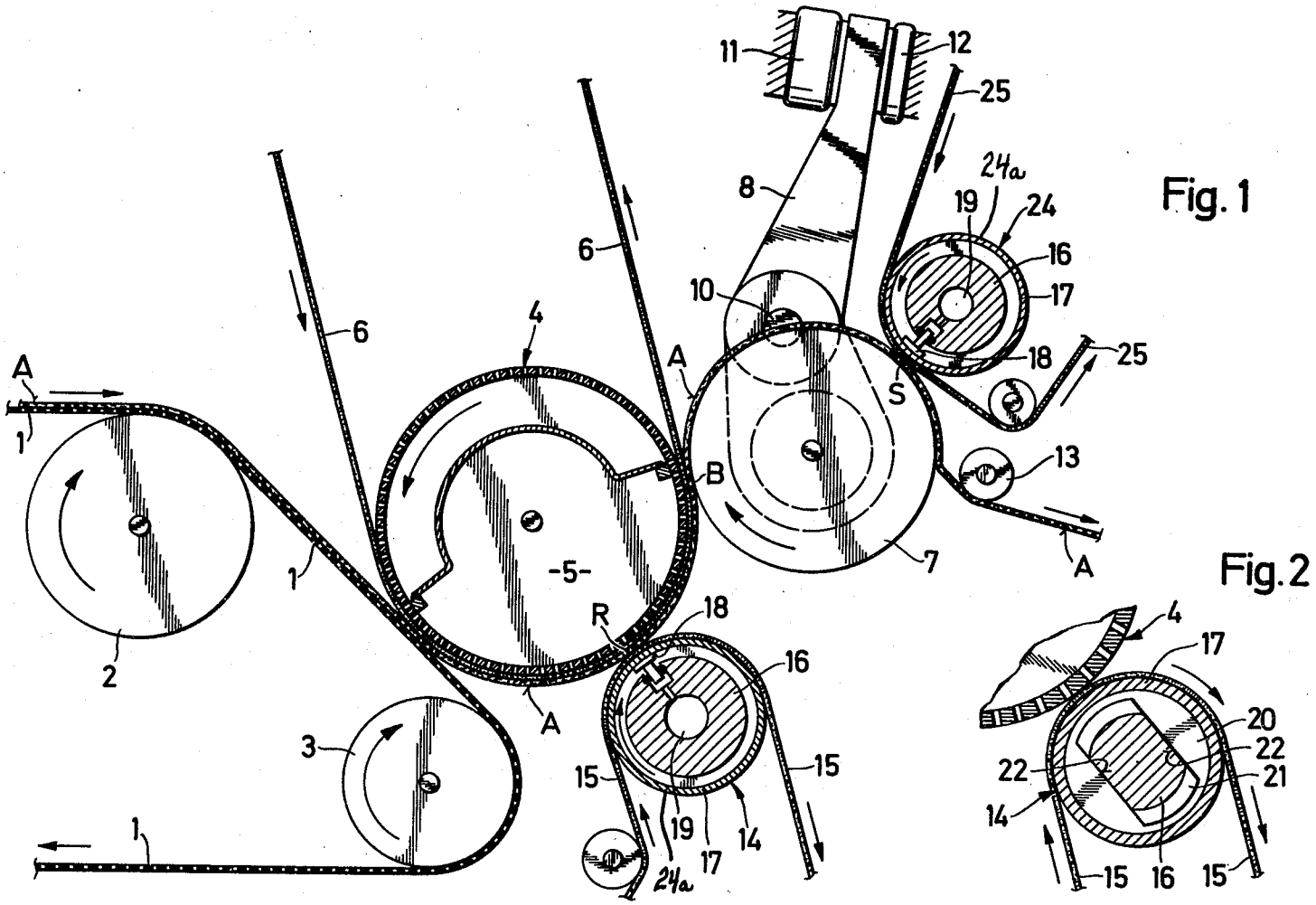
FIG. 1 schematically illustrates a roll press constructed according to the present invention.
FIG. 2 is a sectional view through the controlled deflection roll or flexure adjusting roll of the arrangement of FIG. 1.

Describing now the drawings, it is to be understood that only enough of the structure of the paper-making machine roll press or roller mill of the invention has been illustrated, to simplify the showing, to enable those skilled in the art to readily understand the underlining concepts and principles of the present invention. Turning attention specifically to the embodiment of FIG. 1 there will be seen the end of the wire part of a paper-making machine, comprising a wire 1 or equivalent structure arranged over wire rolls 2 and 3. A suction press roll 4 is provided on the wire 1 and has a suction chamber 5 which is schematically shown. A transfer and press felt 6 is trained over the suction press roll 4. A take-off press roll 7 is pressed in conventional manner against the suction press roll 4 and may, for instance, have a granite surface and forms a press station B together with the suction press roll 4. This press station B is formed at the press nip between the take-off press roll 7 and the suction press roll 4. Also, it will be recognized that the take-off roll 7 is mounted on a bell-crank mechanism 8 pivotable about a pivot 10 and provided with the bellows 11, 12 or equivalent structure, for the purpose of developing the necessary pressure or contact force.

The web of paper A formed on the wire 1 is lifted therefrom in conventional manner by the press felt 6 and the suction press roll 4, then is drained on such suction press roll 4 by means of air which is sucked therethrough, and after the pressing or squeezing operation at the press station B is taken-off the felt 6 by the take-off roll 7. The web of paper A is then withdrawn form the take-off roll via a roll 13.

According to the invention, a press station R embodying a contact-pressure roll 14, over which there is trained a press felt 15, is provided at the region of the suction pressure roll 4 in advance of the press station B between the suction pressure roll 4 and the take-off roll 7. The pressure roll 14 advantageously is a hydrostatic flexure adjusting roll or controlled deflection roll, which may be of the type described in the aforementioned U.S. Pat. Nos. 3,802,044 and 3,885,283. It comprises an inner fixed or stationary support or beam 16 about which there is rotatable a tubular shell or barrel 17. This tubular shell 17 is supported on hydrostatic pistons 18 which receive hydraulic pressure fluid through an internal bore 19 of the support or beam 16. As described in detail in each of the above two United States patents, the disclosure of which is incorporated herein by reference as mentioned previously, the pressure fluid is used on the one hand, to press the hydrostatic pistons 18 against the shell 17 and thus the latter against the suction press roll 4. At the same time the pressure fluid forms a film of lubricant between the hydrostatic pistons 18 and the inner surface of the shell or barrel 17. According to the teachings of the aforementioned U.S. Pat. No. 3,885,283, a guide is disposed at each end of the shell 17 and apart from allowing rotational movement of the shell 17 about the stationary or fixed support 16 it also allows its displacement relative to the support 16 in the pressing direction, i.e. the axial direction of the hydrostatic pistons 18.

Now a system of this type has been shown in greater detail in FIG. 2, constituting a section taken through the roll shell and its support at the region of one end of such shell.

As will be seen from the showing of FIG. 2, the shell or barrel 17 is mounted for rotation on a guide disc 20 formed to possess an elongate aperture or slot 21 defined by the parallel and plane guide surfaces 22. The plane guide surfaces of the support or beam 16 are also guided along the guide surfaces 22.

The use of the controlled deflection roll herein described, which requires no external contact-pressure mechanism, enables another press roll 14 to be disposed in the restricted space between the wire roll 3, the suction press roll 4 and the take-off press roll 7. Since the contact-pressure roll 14 may be provided with the felt 15 and cooperates with the suction press roll 4, over which there is also guided a press felt 6, there is obtained at the press station between the rolls 4 and 14 practically twice the drainage action as would be available between two rolls with a single felt at the press station. An optimum press station is thus realized in this instance, because the still relatively high water content of the web of paper requires a high drainage capacity with careful treatment of the web A.

As will also be seen by referring to FIG. 1, the take-off press roll 7 may be provided with another press roll 24 of the same construction as the contact-press or pressure roll 14. Here again, the absence of any external contact-pressure mechanism greatly simplifies the arrangement of the roll 24. Since only one felt 25 passes between the rolls 7 and 24, the additional drainage action of the roll 24 is no longer as great as that of the roll 14, but such is also no longer necessary, because the web of paper contains only relatively small quantities of water at the region of the press station S between the rolls 7 and 24. Consequently, there is no need for any suction effect of the kind which is produced by the suction press roll 4. All that is needed is for the shell 17 of the roll 24 to have recesses or equivalent structure for receiving the pressed-out water, e.g. circumferential grooves or blind bores, as generally indicated in FIG. 1 by reference character 24*a*. Also, the shell or barrel 17 of the controlled deflection roll 14 equally may be provided with such recesses in the same way, again as generally indicated by reference character 24*a*.

While there are shown and described present preferred embodiments of the invention, it is to be distinctly understood that the invention is not limited thereto, but may be otherwise variously embodied and practiced within the scope of the following claims. Accordingly,

What we claim is:

1. A paper-making machine roll press comprising:
a wire over which passes a web of paper;
a suction press roll positioned to cooperate with said wire;
a press felt trained about said suction press roll;
said suction press roll serving for the direct transfer of the web of paper from the wire;
a take-off press roll cooperating with the suction press roll to form a press station;
said take-off press roll serving for the transfer of the web of paper from the suction press roll and for delivering the same downstream of the papermaking machine;
means defining an additional press station at the region of the suction press roll in advance of the press station with the take-off press roll;
said means defining said additional press station comprising a contact-pressure roll;
a press felt trained about said contact-pressure roll;
said contact-pressure roll comprising a hydrostatic controlled deflection roll embodying a shell and a fixed support; and
means mounting said shell to be rotatable about its lengthwise axis and displaceable in the pressing direction relative to said fixed support.

2. The paper-making machine roll press as defined in claim 1, wherein:
said contact-pressure roll is positioned to cooperate with said suction press roll.

3. A paper-making machine roll press as defined in claim 1, further including:
means cooperating with said take-off press roll for providing at least a second additional press station;

said at least a second additional press station comprising a second press roll;

a press felt trained about said second press roll;

said second press roll comprising a controlled deflection roll having a shell and a fixed support; and means for mounting said shell of said second press roll to be rotatable about its lengthwise axis and displaceable in the pressing direction relative to its fixed support.

4. A paper-making machine roll press as defined in claim 2, wherein:

said shell of the controlled deflection roll being provided with recess means for receiving water which is pressed out of the web of paper at the additional press station.

5. A paper-making machine roll press as defined in claim 3, wherein:

said shell of said second press roll being provided with recess means for receiving water which is pressed-out at said at least a second additional press station.

6. A paper-making machine roll press comprising:

wire means over which passes a web of paper containing water in a predetermined direction of travel;

a suction press roll positioned to cooperate with said wire;

a press felt trained about said suction press roll;

a take-off press roll cooperating with the suction press roll to form a press station;

said take-off press roll serving for the transfer of the web of paper from the suction press roll and for delivering the same downstream of the paper-making machine with respect to said predetermined direction of travel of said web of paper;

means cooperating with said suction press roll for providing an additional press station at the region of the suction press roll in advance of the press station with the take-off press roll;

said means defining said additional press station comprising a contact-pressure roll;

a press felt trained about said contact-pressure roll, to thereby impart to said additional press station a greater water drainage effect for the web of paper than at said press station at the take-off press roll;

said contact-pressure roll comprising a hydrostatic controlled deflection roll embodying a shell and a fixed support; and means mounting said shell to be rotatable about its lengthwise axis and displaceable in the press direction relative to said fixed support.

* * * * *